US006199864B1

(12) United States Patent
Branner

(10) Patent No.: US 6,199,864 B1
(45) Date of Patent: Mar. 13, 2001

(54) MATH GAME

(76) Inventor: Audrey J. Branner, 764 Newman Ct., Pontiac, MI (US) 48340

( * ) Notice: Subject to any disclaimer, the term of this patent is extended or adjusted under 35 U.S.C. 154(b) by 0 days.

(21) Appl. No.: 09/321,155

(22) Filed: May 27, 1999

(51) Int. Cl.[7] ..... A63F 3/00

(52) U.S. Cl. ..... 273/243; 273/248; 273/272; 273/299

(58) Field of Search ..... 273/236, 242, 273/243, 429, 430, 431, 299, 141 R, 248, 272

(56) References Cited

U.S. PATENT DOCUMENTS 1,099,563 * 6/1914 Meyers .
1,167,407 * 1/1916 Johnson .
2,769,640 * 11/1956 Elder .
3,831,946 * 8/1974 Denalsky .
3,967,825 * 7/1976 Anania .
4,029,320 * 6/1977 Hausman .
4,379,700 * 4/1983 Pollock .
4,508,344 * 4/1985 Krogh .
4,561,658 * 12/1985 Peterson .
4,568,086 * 2/1986 Krogh .
5,297,801 * 3/1994 Croaker .
5,445,390 * 8/1995 Dutton .
5,516,111 * 5/1996 Strickland .
5,743,531 * 4/1998 Rosa .

* cited by examiner

*Primary Examiner*—Benjamin H. Layno
*Assistant Examiner*—Vishu Mendiratta

(57) ABSTRACT

A math game for advancing a player's token across a playing surface by correctly answering math questions. The math game includes a playing surface with spaced apart starting and ending sides, and a plurality of playing spaces between the starting and ending sides of the playing surface. The plurality of playing spaces includes a starting playing space adjacent the starting side of the playing surface, an ending space adjacent the ending side of the playing surface, and a plurality of answer playing spaces each having a number displayed therein. A spinner is also provided with a top face having a plurality of spinner spaces each having a mathematical question displayed thereon. The mathematical question of each spinner space has a correct answer equal to the number displayed on a corresponding one of the answer playing spaces. The spinner also has a rotatably mounted pointer for randomly selecting one of the spinner spaces. Each player spins the spinner to designate an active spinner space. The player must then correctly answer the mathematical question displayed on the active spinner space. If the player correctly answers the posed mathematically question, the playing piece of the player is advanced on to the answer space displaying the correct answer to the mathematical question of the active spinner space.

1 Claim, 2 Drawing Sheets

MATH GAME

BACKGROUND OF THE INVENTION

1. Field of the Invention

The present invention relates to math game and more particularly pertains to a new math game for advancing a player's token across a playing surface by correctly answering math questions.

2. Description of the Prior Art

The use of math game is known in the prior art. More specifically, math game heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,014,547; U.S. Pat. No. 3,984,108; U.S. Pat. No. Des. 249,697; U.S. Pat. No. 3,170,696; U.S. Pat. No. 3,342,493; and U.S. Pat. No. 3,224,114.

While these devices fulfill their respective, particular objectives and requirements, the aforementioned patents do not disclose a new math game. The inventive device includes a playing surface with spaced apart starting and ending sides, and a plurality of playing spaces between the starting and ending sides of the playing surface. The plurality of playing spaces includes a starting playing space adjacent the starting side of the playing surface, an ending space adjacent the ending side of the playing surface, and a plurality of answer playing spaces each having a number displayed therein. A spinner is also provided with a top face having a plurality of spinner spaces each having a mathematical question displayed thereon. The mathematical question of each spinner space has a correct answer equal to the number displayed on a corresponding one of the answer playing spaces. The spinner also has a rotatably mounted pointer for randomly selecting one of the spinner spaces. Each player spins the spinner to designate an active spinner space. The player must then correctly answer the mathematical question displayed on the active spinner space. If the player correctly answers the posed mathematically question, the playing piece of the player is advanced on to the answer space displaying the correct answer to the mathematical question of the active spinner space.

In these respects, the math game according to the present invention substantially departs from the conventional concepts and designs of the prior art, and in so doing provides an apparatus primarily developed for the purpose of advancing a player's token across a playing surface by correctly answering math questions.

SUMMARY OF THE INVENTION

In view of the foregoing disadvantages inherent in the known types of math game now present in the prior art, the present invention provides a new math game construction wherein the same can be utilized for advancing a player's token across a playing surface by correctly answering math questions.

The general purpose of the present invention, which will be described subsequently in greater detail, is to provide a new math game apparatus and method which has many of the advantages of the math game mentioned heretofore and many novel features that result in a new math game which is not anticipated, rendered obvious, suggested, or even implied by any of the prior art math game, either alone or in any combination thereof.

To attain this, the present invention generally comprises a playing surface with spaced apart starting and ending sides, and a plurality of playing spaces between the starting and ending sides of the playing surface. The plurality of playing spaces includes a starting playing space adjacent the starting side of the playing surface, an ending space adjacent the ending side of the playing surface, and a plurality of answer playing spaces each having a number displayed therein. A spinner is also provided with a top face having a plurality of spinner spaces each having a mathematical question displayed thereon. The mathematical question of each spinner space has a correct answer equal to the number displayed on a corresponding one of the answer playing spaces. The spinner also has a rotatably mounted pointer for randomly selecting one of the spinner spaces. Each player spins the spinner to designate an active spinner space. The player must then correctly answer the mathematical question displayed on the active spinner space. If the player correctly answers the posed mathematically question, the playing piece of the player is advanced on to the answer space displaying the correct answer to the mathematical question of the active spinner space.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new math game apparatus and method which has many of the advantages of the math game mentioned heretofore and many novel features that result in a new math game which is not anticipated, rendered obvious, suggested, or even implied by any of the prior art math game, either alone or in any combination thereof.

It is another object of the present invention to provide a new math game which may be easily and efficiently manufactured and marketed.

It is a further object of the present invention to provide a new math game which is of a durable and reliable construction.

An even further object of the present invention is to provide a new math game which is susceptible of a low cost of manufacture with regard to both materials and labor, and which accordingly is then susceptible of low prices of sale to the consuming public, thereby making such math game economically available to the buying public.

Still yet another object of the present invention is to provide a new math game which provides in the apparatuses and methods of the prior art some of the advantages thereof, while simultaneously overcoming some of the disadvantages normally associated therewith.

Still another object of the present invention is to provide a new math game for advancing a player's token across a playing surface by correctly answering math questions.

Yet another object of the present invention is to provide a new math game which includes a playing surface with spaced apart starting and ending sides, and a plurality of playing spaces between the starting and ending sides of the playing surface. The plurality of playing spaces includes a starting playing space adjacent the starting side of the playing surface, an ending space adjacent the ending side of the playing surface, and a plurality of answer playing spaces each having a number displayed therein. A spinner is also provided with a top face having a plurality of spinner spaces each having a mathematical question displayed thereon. The mathematical question of each spinner space has a correct answer equal to the number displayed on a corresponding one of the answer playing spaces. The spinner also has a rotatably mounted pointer for randomly selecting one of the spinner spaces. Each player spins the spinner to designate an active spinner space. The player must then correctly answer the mathematical question displayed on the active spinner space. If the player correctly answers the posed mathematically question, the playing piece of the player is advanced on to the answer space displaying the correct answer to the mathematical question of the active spinner space.

Still yet another object of the present invention is to provide a new math game that provides an entertaining positive reinforcement means for teaching users math by rewarding their token upon correct answering of a math question posed to the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
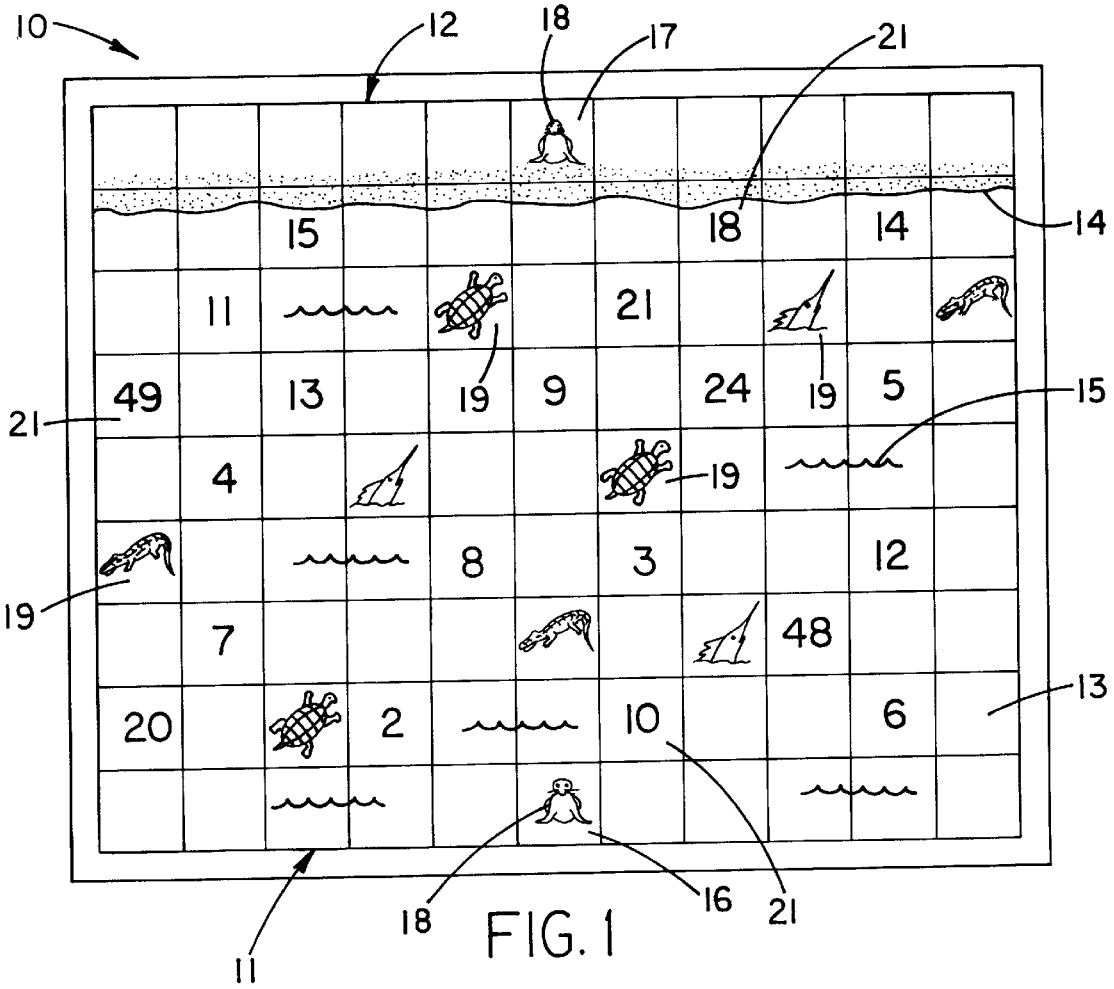
FIG. 1 is a schematic plan view of the playing surface of the math game according to the present invention.
Figure 2:
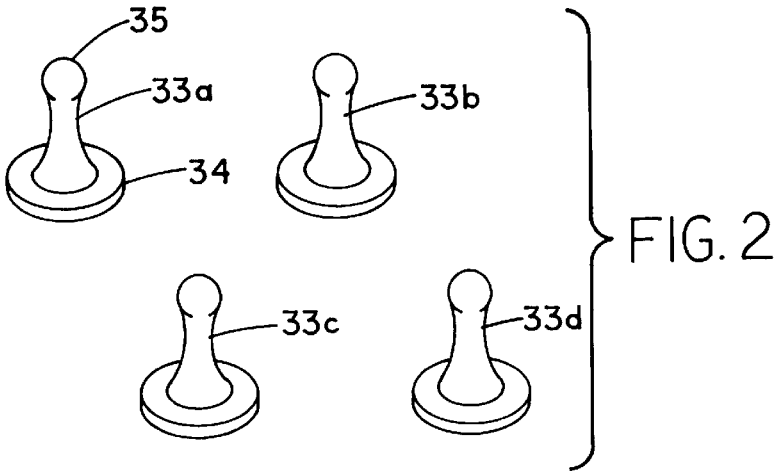
FIG. 2 is a schematic perspective view of a plurality of playing pieces of the present invention.
Figure 3:
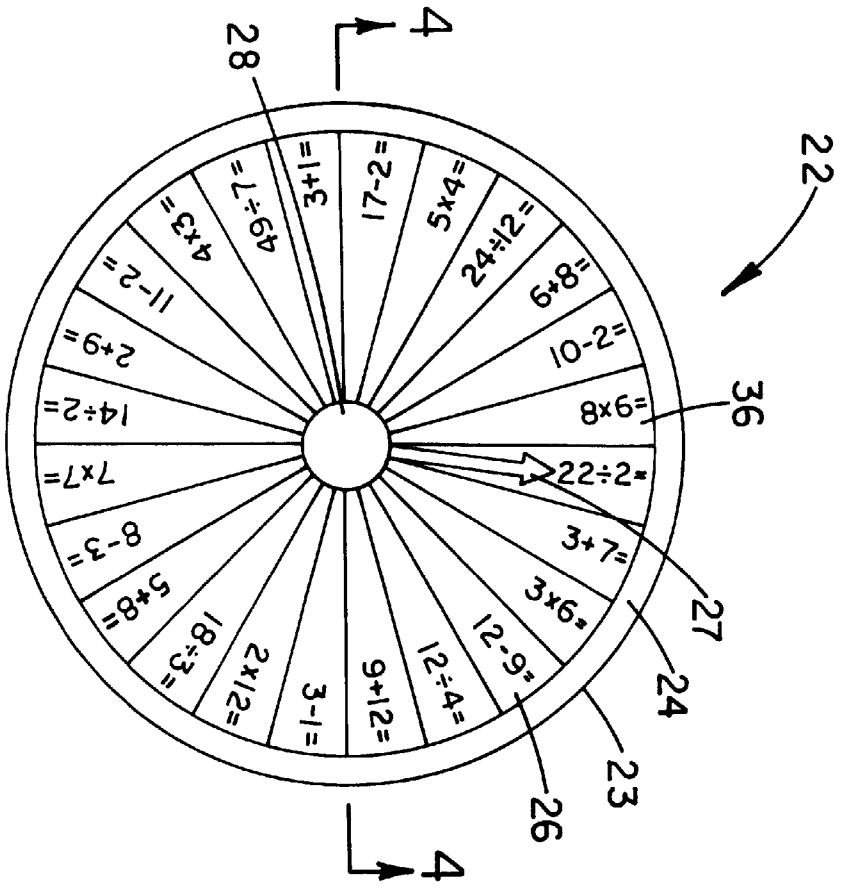
FIG. 3 is a schematic top view of the top face of the spinner.
Figure 4:
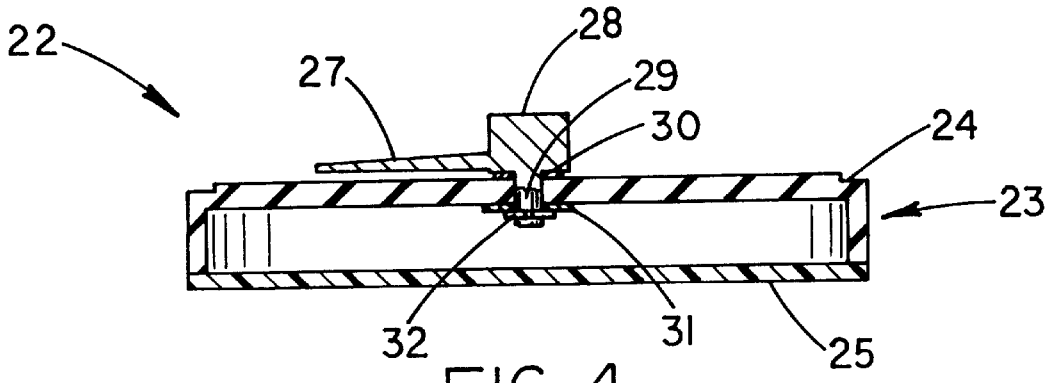
FIG. 4 is a schematic cross sectional view of the spinner taken from line 4—4 of FIG. 3.

With reference now to the drawings, and in particular to FIG. 1 through 4 thereof, a new math game embodying the principles and concepts of the present invention will be described.

As best illustrated in FIGS. 1 through 4, the math game generally comprises a playing surface with spaced apart starting and ending sides, and a plurality of playing spaces between the starting and ending sides of the playing surface. The plurality of playing spaces includes a starting playing space adjacent the starting side of the playing surface, an ending space adjacent the ending side of the playing surface, and a plurality of answer playing spaces each having a number displayed therein. A spinner is also provided with a top face having a plurality of spinner spaces each having a mathematical question displayed thereon. The mathematical question of each spinner space has a correct answer equal to the number displayed on a corresponding one of the answer playing spaces. The spinner also has a rotatably mounted pointer for randomly selecting one of the spinner spaces. Each player spins the spinner to designate an active spinner space. The player must then correctly answer the mathematical question displayed on the active spinner space. If the player correctly answers the posed mathematically question, the playing piece of the player is advanced on to the answer space displaying the correct answer to the mathematical question of the active spinner space.

In closer detail, the math game includes a generally rectangular playing surface 10 having spaced apart and substantially parallel starting and ending sides 11,12, and a plurality of generally rectangular playing spaces 13 preferably arranged in a rectangular grid between the starting and ending sides of the playing surface. Preferably, the playing surface has an illustration providing thereon beneath the playing spaces illustrating a beach shore line 14 and a body of water 15. The beach shore line is extended adjacently along the ending side of the playing surface. The body of water is extended from the beach shore line to the starting side of the playing surface.

The plurality of playing spaces includes a starting playing space 16 adjacent the starting side of the playing surface and an ending space 17 adjacent the ending side of the playing surface. Ideally, the starting and ending playing spaces each has an image of a seal 18 displayed therein representing Allanté the Seal. The plurality of playing spaces also ideally include a plurality of obstacle playing spaces 19, each of the obstacle playing spaces has an illustration 20 of an animal representing an obstacle therein such as, for example, an alligator, a snapping turtle, a swordfish, and even a jellyfish.

The plurality of playing spaces further include a plurality of answer playing spaces 21 each having a number displayed therein in numeric indicia, unique from the all the other answer playing spaces.

The game also includes a spinner 22 having a base 23 that is preferably generally cylindrical in shape and has spaced apart and generally circular top and bottom faces 24,25. The bottom face of the base ideally comprises a resiliently deformable material such as a resiliently deformable rubber or plastic material for frictionally enhancing contact between the bottom face of the base and a resting surface on which it rests to help prevent the base from slipping on the resting surface during use of the spinner.

The top face of the base has center, and a plurality of pie-wedge-shaped spinner spaces 26 displayed thereon and outwardly radiating from the center of top face. Each of the spinner spaces has mathematical indicia posing a mathematical question displayed thereon. Any type of math question may be posed, for example,: "3+7=". "3×6=" and so on. Optionally, overlays may also be provided for overlaying on the top face of the base to provide spinner spaces with new, harder or easier mathematical questions thereon.

The mathematical question of each spinner space has a correct answer equal to the number displayed on a corresponding one of the answer playing spaces. For example there is an answer playing space with the number "10" displayed thereon which is equal to the answer of the spinner space posing the mathematical question "3+7=" and there is an answer playing space with the number "18" displayed thereon which is equal to the answer of the spinner space posing the mathematical question "3×6=".

The spinner also has a pointer 27 rotatably mounted to the center of the top face to permit free rotation of the pointer about the center of the top face in a plane generally parallel to the top face of the base. Ideally, the pointer has an generally disk-shaped spinning dial 28 upwardly extending from the center of the top face of the base. In use, the spinning dial is designed for permitting spinning the of the pointer with the fingers of a user. The pointer also has a generally cylindrical center extent 29 downwardly extending through the top face of the base to permit rotation of the center extent. A spaced apart pair of annular washers 30,31 are disposed about the center extent, the top face of the base is interposed between the annular washers. A retaining collar 32 is disposed about and coupled to the center extent in the base such that one of the annular washers is interposed between top face of the base and the retaining collar. In use, the retaining collar prevents the center extent from is removed from the top face of the base.

A plurality of playing tokens 33*a*, 33*b*, 33*c*, 33*d* are also provided. Ideally, each playing token has a generally circular resting base 34 for enhancing the stability of the respective playing piece and a generally spherical upper knob 35 for permitting easier grasping of the respective playing piece.

In use, the math game is designed for play with a plurality of players. Each player is assigned one of the playing tokens. The playing tokens of each player are first placed on the starting playing space. A first player is selected from the plurality of players. A plurality of player turns are then performed with each player performing alternating player turns with the other players and the first player performing a first of the plurality of player turns.

Each player turn comprises the acts of first spinning the pointer of the spinner such that the pointer terminates its rotation above one of the spinner spaces so that the one spinner spaces is designated the active spinner space 36 of the respective turn. The player must then answer the mathematical question displayed on the active spinner space. When the player correctly answers the mathematical question of the active spinner space, the player advances their playing piece on to the answer space displaying the correct answer to the mathematical question of the active spinner space. Conversely, when the player incorrectly answers the mathematical question of the active spinner space, the playing piece of the player is moved back on to the previous playing space on which the playing piece occupied prior to the commencement of the present playing turn. A player may only advance their playing piece to the ending playing space when: (1) their playing piece occupies an answer space adjacent ending side (or beach coast line) of the playing surface and (2) upon the player correctly answering of the mathematical question posed by the active spinner space.

A winner is declared as the first player to have their playing piece reach the ending space.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a math game, comprising the acts of:

providing a generally rectangular playing surface having spaced apart and substantially parallel starting and ending sides, and a plurality of generally rectangular playing spaces arranged in a rectangular grid between said starting and ending sides of said playing surface;

said playing Surface having an illustration providing thereon beneath said playing spaces such that said grid of said playing spaces is overlaid over said illustration, said illustration illustrating a beach shore line and a body of water, said beach shore line being extended adjacently along said ending side of said playing surface, said body of water being extended from said beach shore line to said starting side of said playing surface;

said plurality of playing spaces including a starting playing space adjacent said starting side of said playing surface and an ending space adjacent said ending side of said playing surface;

said starting and ending playing spaces each having an image of a seal displayed therein;

said plurality of playing spaces including a plurality of obstacle playing spaces;

said plurality of playing spaces including a plurality of answer playing spaces each having a number displayed therein in numeric indicia, said number of any one of said answer playing spaces being unique from said number of any other of said answer playing spaces such that only one of said answer spaces is selectable for each number;

providing a spinner comprising:

a base being generally cylindrical in shape and having spaced apart and generally circular top and bottom faces, said bottom face of said base comprising a resiliently deformable material for frictionally enhancing contact between said bottom face of said base and a resting surface on which said spinner rests for facilitating prevention said base from slipping during use of said spinner;

said top face of said base having center, and a plurality of pie-wedge-shaped spinner spaces displayed thereon and outwardly radiating from said center of top face;

each of said spinner spaces having a mathematical question displayed thereon, said mathematical question of each spinner space having a correct answer equal to the number displayed on a corresponding one of said answer playing spaces;

a pointer being rotatably mounted to said center of said top face to permit free rotation of said pointer about said center of said top face in a plane generally parallel to said top face of said base;

wherein said pointer has an generally disk-shaped spinning dial upwardly extending from said center of said top face of said base, said spinning dial being adapted for permitting spinning said of said pointer with the fingers of a user;

wherein said pointer has a downwardly extending generally cylindrical center extent downwardly extending through said top face of said base to permit rotation of said center extent, a spaced apart pair of annular washers being disposed about said center extent, said top face of said base being interposed between said annular washers, and wherein a retaining collar is disposed about and coupled to said center extent in said base such that one of said annular washers is interposed between top face of said base and said retaining collar, said retaining collar preventing said center extent from being removed from said top face of said base;

providing a plurality of playing tokens, each playing token having a generally circular resting base for enhancing stability of said playing token and a generally spherical upper knob for permitting easier grasping of said playing token;

providing a plurality of players;

assigning each player one of said playing tokens;

placing said playing tokens of each player on said starting playing space;

selecting a first player from said plurality of players;

performing a plurality of player turns with each player performing alternating player turns with the other players and said first player performing a first of said plurality of player turns;

each player turn comprising the acts of:

spinning said pointer of said spinner such that said pointer terminates its rotation above one of said spinner spaces so that said one spinner spaces is designated the active spinner space of the respective turn;

answering the mathematical question displayed on said active spinner space;

advancing the playing token of the respective player on to the answer space displaying the correct answer to the mathematical question of the active spinner space when the player correctly answers the mathematical question of the active spinner space;

moving the playing token of the respective player on to the previous playing space on which said playing piece occupied prior to the commencement of the present playing turn when the player incorrectly answers the mathematical question of the active spinner space;

advancing said playing token to said ending playing space upon the player correctly answering said mathematical question posed by said active spinner space when said playing token occupies an answer space adjacent said beach coast line; and declaring a winner as the first player to have respective playing token reach said ending space.

* * * * *